US010581177B2

(12) United States Patent
Isom et al.

(10) Patent No.: US 10,581,177 B2
(45) Date of Patent: Mar. 3, 2020

(54) HIGH FREQUENCY POLYMER ON METAL RADIATOR

(71) Applicant: Raytheon Company, Waltham, MA (US)

(72) Inventors: Robert S. Isom, Allen, TX (US); Andrew J. Marquette, Redondo Beach, CA (US); Jason G. Milne, Hawthorne, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 15/379,775

(22) Filed: Dec. 15, 2016

(65) Prior Publication Data

US 2018/0175513 A1 Jun. 21, 2018

(51) Int. Cl.

| | |
|---|---|
| ***H01Q 21/06*** | (2006.01) |
| ***H01Q 9/04*** | (2006.01) |
| ***H01Q 9/28*** | (2006.01) |
| ***H01Q 3/26*** | (2006.01) |
| ***H01Q 21/00*** | (2006.01) |

(Continued)

(52) U.S. Cl.

CPC ..... *H01Q 21/062* (2013.01); *H01Q 3/26* (2013.01); *H01Q 9/0407* (2013.01); *H01Q 9/0492* (2013.01); *H01Q 9/285* (2013.01); *H01Q 21/0006* (2013.01); *H01Q 21/0025* (2013.01); *H01Q 21/0087* (2013.01); *H01Q 25/001* (2013.01); *H01Q 21/22* (2013.01)

(58) Field of Classification Search

CPC ..... H01Q 21/062; H01Q 9/0428; H01Q 21/0062; H01Q 19/136; H01Q 21/065; H01Q 21/24

See application file for complete search history.

(56) References Cited

U.S. PATENT DOCUMENTS

| | | | |
|---|---|---|---|
| 2,015,028 | A | 9/1935 | Gillette |
| 3,528,050 | A | 9/1970 | Hindenburg |

(Continued)

FOREIGN PATENT DOCUMENTS

| | | | |
|---|---|---|---|
| CN | 103247581 | A | 8/2013 |
| CN | 204857954 | U | 12/2015 |

(Continued)

OTHER PUBLICATIONS

Response to U.S. Non-Final Office Action dated May 18, 2017 for U.S. Appl. No. 14/881,582; Response filed on Jun. 5, 2017; 7 Pages.

(Continued)

*Primary Examiner* — Ricardo I Magallanes

(74) *Attorney, Agent, or Firm* — Daly Crowley Mofford & Durkee, LLP

(57) ABSTRACT

In one aspect, a unit cell of a phased array antenna includes a metal plate having a hole, a first side and a second side opposite the first side, a first plurality of laminate layers disposed on the first side, a second plurality of layers disposed on the second side of the metal plate, a radiator disposed in the first plurality of layer on the first side, a feed circuit disposed in the second plurality of laminate layers on the second side and configured to provide excitation signals to the radiator and a first plurality of vias extending through the hole connecting the feed circuit to the radiator.

20 Claims, 8 Drawing Sheets

(51) Int. Cl.
*H01Q 25/00* (2006.01)
*H01Q 21/22* (2006.01)

(56) References Cited

U.S. PATENT DOCUMENTS 4,690,471 A 9/1987 Marabotto et al.
5,172,082 A 12/1992 Livingston et al.
5,410,281 A 4/1995 Blum
5,434,575 A 7/1995 Jelinek et al.
5,453,751 A 9/1995 Tsukamoto et al.
5,455,546 A 10/1995 Frederick et al.
5,603,620 A 2/1997 Hinze et al.
5,644,277 A 7/1997 Gulick et al.
5,745,079 A 4/1998 Wang et al.
5,880,694 A 3/1999 Wang et al.
5,886,590 A 3/1999 Quan et al.
5,995,047 A 11/1999 Freyssinier et al.
6,100,775 A 8/2000 Wen
6,114,997 A * 9/2000 Lee ..... H01Q 1/38 343/700 MS
6,147,648 A 11/2000 Granholm et al.
6,184,832 B1 2/2001 Geyh et al.
6,320,542 B1 11/2001 Yamamoto et al.
6,429,816 B1 8/2002 Whybrew et al.
6,459,415 B1 10/2002 Pachal et al.
6,512,487 B1 1/2003 Taylor et al.
6,664,867 B1 12/2003 Chen
6,686,885 B1 2/2004 Barkdoll et al.
6,856,297 B1 2/2005 Durham et al.
6,867,742 B1 3/2005 Irion, II et al.
6,876,336 B2 4/2005 Croswell et al.
6,882,247 B2 4/2005 Allison et al.
6,935,866 B2 8/2005 Kerekes et al.
6,977,623 B2 12/2005 Durham et al.
7,012,572 B1 3/2006 Schaffner et al.
7,084,827 B1 8/2006 Strange et al.
7,113,142 B2 9/2006 McCarville et al.
7,132,990 B2 11/2006 Stenger et al.
7,138,952 B2 11/2006 Mcgrath et al.
7,193,490 B2 3/2007 Shimoda
7,221,322 B1 5/2007 Durham et al.
7,272,880 B1 9/2007 Pluymers et al.
7,315,288 B2 1/2008 Livingston et al.
7,358,921 B2 4/2008 Snyder et al.
7,411,472 B1 8/2008 West et al.
7,414,590 B2 8/2008 Bij De Vaate et al.
7,688,265 B2 3/2010 Irion, II et al.
7,948,441 B2 5/2011 Irion, II et al.
8,035,992 B2 10/2011 Kushta et al.
8,325,093 B2 12/2012 Holland et al.
8,753,145 B2 6/2014 Lang et al.
9,136,572 B2 9/2015 Carr et al.
9,402,301 B2 7/2016 Paine et al.
9,437,929 B2 9/2016 Isom et al.
9,490,519 B2 11/2016 Lilly et al.
9,537,208 B2 1/2017 Isom
2003/0020654 A1 1/2003 Navarro et al.
2003/0112200 A1 6/2003 Marino
2003/0184476 A1 10/2003 Sikina et al.
2005/0007286 A1 1/2005 Trott et al.
2005/0156802 A1* 7/2005 Livingston ..... H01Q 13/10 343/770
2006/0097947 A1 5/2006 McCarville et al.
2008/0036665 A1 2/2008 Schadler
2008/0150832 A1 6/2008 Ingram et al.
2008/0169992 A1 7/2008 Ortiz et al.
2009/0073075 A1 3/2009 Irion, II et al.
2009/0091506 A1 4/2009 Navarro et al.
2009/0121967 A1 5/2009 Cunningham
2010/0164783 A1 7/2010 Choudhury et al.
2011/0089531 A1 4/2011 Hillman et al.
2012/0034820 A1 2/2012 Lang et al.
2012/0068906 A1 3/2012 Asher et al.
2012/0098706 A1 4/2012 Lin et al.
2012/0146869 A1* 6/2012 Holland ..... H01P 5/10 343/795
2012/0212386 A1* 8/2012 Massie ..... H01Q 1/243 343/850
2012/0287581 A1 11/2012 Sauerbier et al.
2012/0306698 A1 12/2012 Warnick et al.
2012/0313818 A1 12/2012 Puzella et al.
2013/0026586 A1* 1/2013 Seok ..... H01L 31/08 257/428
2013/0050055 A1 2/2013 Paradiso et al.
2013/0175078 A1 7/2013 Pai
2013/0187830 A1* 7/2013 Warnick ..... H01Q 5/35 343/893
2013/0194754 A1 8/2013 Jung et al.
2013/0207274 A1 8/2013 Liu et al.
2013/0314292 A1 11/2013 Maley
2014/0132473 A1 5/2014 Isom
2014/0264759 A1 9/2014 Koontz et al.
2015/0015453 A1 1/2015 Puzella et al.
2015/0200460 A1 7/2015 Isom et al.
2015/0353348 A1 12/2015 Vandemeer et al.
2016/0172755 A1 6/2016 Chen et al.
2016/0352023 A1 12/2016 Dang et al.
2018/0040955 A1* 2/2018 Vouvakis ..... H01Q 5/25
2018/0090851 A1* 3/2018 Feldman ..... H01Q 21/065
2018/0337461 A1* 11/2018 Kildal ..... H01Q 9/28

FOREIGN PATENT DOCUMENTS

EP 1 970 952 A2 9/2008
EP 1 970 952 A3 9/2008
JP U-1992027609 3/1992
JP H07-106841 4/1995
JP 2000-312112 A 11/2000
JP 2006-504375 A 2/2006
JP 6195935 B2 9/2017
TW 2014-03765 A 1/2014
TW 2014-34203 A 9/2014
TW 2016-05017 A 2/2016
WO WO 2009/077791 A1 6/2009
WO WO 2014/168669 A1 10/2014
WO WO 2015/006293 A1 1/2015
WO WO 2016/138267 A1 9/2016
WO WO 2016/138267 A8 9/2016

OTHER PUBLICATIONS

U.S. Appl. No. 15/381,286, filed Dec. 16, 2016, Teshiba et al.
U.S. Appl. No. 15/379,761, filed Dec. 15, 2016, Isom.
Chang-Chien et al., "MMIC Compatible Wafer-Level Packaging Technologoy;" Proceedings of the International Conference on Indium Phosphide and Related Materials (19th IPRM); May 14-18, 2007; 4 Pages.
Chang-Chien et al., "MMIC Packaging and Heterogeneous Integration Using Wafer-Scale Assembly;" Proceedings of the CS MANTECH Conference; May 14-17, 2007; 4 Pages.
Chang-Chien, "Wafer-Level Packaging and Wafer-Scale Assembly Technologies;" Presentation by Northrop Grumman Aerospace Systems (NGAS); Proceedings of the CS MANTECH Workshop 6; May 17, 2010; 43 Pages.
Green, "DARPA's Heterogeneous Integration Vision and Progress on Modular Design;" Presentation by DARPA; Proceedings of the 3D Architectures for Semiconductor Integration and Packaging Conference (ASIP); Dec. 17, 2015; 17 Pages.
Gu et al., "W-Band Scalable Phased Arrays for Imaging and Communications;" Integrated Circuits for Communications, IEEE Communications Magazine; Apr. 2015; 9 Pages.
Popovic, "Micro-coaxial Micro-fabricated Feeds for Phased Array Antennas;" Proceedings of the 2010 IEEE International Symposium on Phased Array Systems and Technology (ARRAY); Oct. 12-15, 2010; 10 Pages.
Shin et al., "A 108-114 GHz 4x4 Wafer-Scale Phased Array Transmitter with High-Efficiency On-Chip Antennas;" IEEE Journal of Solid-State Circuits, vol. 48, No. 9; Sep. 2013; 15 Pages.
Urteaga, "3D Heterogeneous Integration of III-V Devices and Si CMOS;" Presentation by Teledyne Scientific Company; Proceed-

(56) References Cited

OTHER PUBLICATIONS ings of the 3D Architectures for Semiconductor Integration and Packaging Conference (ASIP); Dec. 17, 2015; 26 Pages.
Zihir et al., "A 60 GHz 64-element Wafer-Scale Phased-Array with Full-Reticle Design;" Proceedings of the 2015 IEEE MTT-S International Microwave Symposium; May 17-22, 2015; 3 Pages.
U.S. Non-Final Office Action dated May 18, 2017 for U.S. Appl. No. 14/881,582; 21 Pages.
PCT International Search Report and Written Opinion dated Jan. 3, 2018 for International Application No. PCT/US2017/055059; 17 Pages.
PCT International Search Report and Written Opinion dated Jan. 3, 2018 for International Application No. PCT/US2017/055222; 16 Pages.
Luo et al.; "Meander Line Coupled Cavity-Backed Slot Antenna for Broadband Circular Polarization"; IEEE Antennas and Wireless Propagation Letters; vol. 14; Feb. 2, 2015; 4 Pages.
Japanese Office Action dated Feb. 28, 2017 for Japanese Pat. App. No. 2015-541757 with English Translations; 4 Pages.
U.S. Appl. No. 14/881,582, filed Oct. 13, 2015, Viscarra et al.
U.S. Office Action dated Jun. 8, 2015 corresponding to U.S. Appl. No. 13/674,547; 23 Pages.
Response to U.S. Office Action dated Jun. 8, 2015 corresponding to U.S. Appl. No. 13/674,547; Response filed on Aug. 28, 2015; 18 Pages.
U.S. Final Office Action dated Dec. 3, 2015 corresponding to U.S. Appl. No. 13/674,547; 22 Pages.
Response to U.S. Final Office Action dated Dec. 3, 2015 corresponding to U.S. Appl. No. 13/674,547; Response filed on Feb. 22, 2016; 16 Pages.
U.S. Office Action dated Apr. 7, 2016 corresponding to U.S. Appl. No. 13/674,547; 27 Pages.
Response to U.S. Office Action dated Apr. 7, 2016 corresponding to U.S. Appl. No. 13/674,547; Response filed on Jun. 21, 2016; 16 Pages.
U.S. Final Office Action dated Jul. 1, 2016 corresponding to U.S. Appl. No. 13/674,547; 30 Pages.
Response to U.S. Final Office Action dated Jul. 1, 2016 corresponding to U.S. Appl. No. 13/674,547; Response filed on Aug. 18, 2016; 14 Pages.
Notice of Allowance dated Sep. 16, 2016 corresponding to U.S. Appl. No. 13/674,547; 17 Pages.
PCT International Search Report and Written Opinion dated Jun. 28, 2013 corresponding to International Application No. PCT/US2013/038408; 14 Pages.
PCT International Preliminary Report dated May 21, 2015 corresponding to International Application No. PCT/US2013/038408; 9 Pages.
European 161/162 Communication dated Jul. 9, 2015 corresponding to European Application No. 13721516.6; 2 Pages.
Response (with Amended Claims) to European 161/162 Communication dated Jul. 9, 2015 corresponding to European Application No. 13721516.6; Response filed on Jan. 19, 2016; 34 Pages.
Korean Office Action (with English Translation) dated Feb. 27, 2016 corresponding to Korean Application No. 10-2015-7010618; 4 Pages.
Response (with Foreign Associate Reporting Letter) to Korean Office Action dated Feb. 27, 2016 corresponding to Korean Application No. 10-2015-7010618; Response filed on Apr. 27, 2016; 15 Pages.
Japanese Office Action (with English Translation) dated Jun. 21, 2016 corresponding to Japanese Application No. 2015-541757; 8 Pages.
Response (with Foreign Associate Reporting Letter) to Japanese Office Action dated Jun. 21, 2016 corresponding to Japanese Application No. 2015-541757; Response filed on Sep. 21, 2016; 7 Pages.
PCT International Search Report and Written Opinion dated Aug. 30, 2016 corresponding to International Application No. PCT/US2016/034045; 11 Pages.
Hotte et al., "Directive and High-Efficiency Slotted Waveguide Antenna Array for V-Band Made by Wire Electrical Discharge Machining;" Electronics Letters, vol. 51, No. 5; Mar. 5, 2015; 2 Pages.
Kasemodel et al., "Broadband Array Antenna Enhancement with Spatially Engineered Dielectric;" U.S. Appl. No. 13/590,769, filed Aug. 21, 2012; 19 Pages.
Kasemodel et al., "Broadband Planar Wide-Scan Array Employing Tightly Coupled Elements and Integrated Balun;" Proceedings of the IEEE International Symposium on Phased Array Systems and Technology (ARRAY); Oct. 12-15, 2010; 6 Pages.
Kindt et al., "Polarization Correction in Dual-Polarized Phased Arrays of Flared Notches;" Proceedings of the IEEE International Symposium on Antennas and Propagation (APSURSI); Jul. 3-8, 2011; 4 Pages.
Mishra et al., "Array of SIW Resonant Slot Antenna for V Band Applications;" Proceedings of the International Conference on Microwave and Photoics (ICMAP); Dec. 13-15, 2013; 4 Pages.
Nesic et al., "Wideband Printed Antenna with Circular Polarization;" Proceedings of the IEEE Antennas and Propagation Society International Symposium; Jul. 13-18, 1997; 4 Pages.
Wong et al., "Broad-Band Single-Patch Circularly Polarized Microstrip Antenna with Dual Capacitively Coupled Feeds;" Proceedings of the IEEE Transactions on Antennas and Propagation, vol. 49, No. 1; Jan. 2001; 4 Pages.
Wong et al., "Design of Dual-Polarized L-Probe Patch Antenna Arrays With High Isolation;" Proceedings of the IEEE Transactions on Antennas and Propagation, vol. 52, No. 1; Jan. 2004; 8 Pages.
Wu et al., "A Wideband High-Gain High-Efficiency Hybrid Integrated Plate Array Antenna for V-Band Inter-Satellite Links;" Proceedings of the IEEE Transactions on Antennas and Propagation, vol. 63, No. 4; Apr. 2015; 9 Pages.
PCT International Search Report and Written Opinion dated Dec. 8, 2017 for International Application No. PCT/US2017/054836; 15 Pages.
Notice of Allowance dated Jun. 23, 2017 for U.S. Appl. No. 14/881,582; 8 Pages.
PCT International Preliminary Report and Written Opinion dated Apr. 26, 2018 for International Application No. PCT/US2016/034045; 8 Pages.
Response to U.S. Non-Final Office Action dated Apr. 5, 2018 for U.S. Appl. No. 15/379,761; Response filed Aug. 1, 2018; 23 Pages.
U.S. Non-Final Office Action dated Apr. 5, 2018 for U.S. Appl. No. 15/379,761; 20 pages.
Taiwan Office Action (with Search Report) dated Jun. 19, 2018 for Taiwan Application No. 106135418; 18 pages.
U.S. Non-Final Office Action dated Jul. 5, 2018 for U.S. Appl. No. 15/381,286; 8 pages.
U.S. Appl. No. 15/731,906, filed Aug. 4, 2017, Isom.
Tong et al., "Novel Sequential Rotation Technique for Broadband Circularly Polarized Microstrip Ring Antennas;" Loughborough Antennas & Propagation Conference; Mar. 17, 2008; 4 Pages.
PCT International Search Report and Written Opinion dated Apr. 26, 2018 for International Application No. PCT/US2018/015421; 15 Pages.
Response (with English Translation of Response, Current Claims and Amended Specification) to Taiwan Office Action dated Jun. 19, 2018 for Taiwan Application No. 106135418; Response filed on Sep. 12, 2018; 40 Pages.
Response to U.S. Non-Final Office Action dated Jul. 5, 2018 for U.S. Appl. No. 15/381,286; Response filed on Sep. 6, 2018; 8 Pages.
U.S. Final Office Action dated Sep. 14, 2018 for U.S. Appl. No. 15/379,761; 20 Pages.
U.S. Non-Final Office Action dated Oct. 9, 2018 for U.S. Appl. No. 15/731,906; 13 Pages.
Response to U.S. Non-Final Office Action dated Oct. 9, 2018 for U.S. Appl. No. 15/731,906; Response filed Nov. 16, 2018; 12 Pages.
Response to U.S. Final Office Action dated Sep. 14, 2018 for U.S. Appl. No. 15/379,761; Response filed on Dec. 14, 2018; 11 Pages.
Taiwan Examination Report (with English Translation) dated Oct. 31, 2018 for Taiwan Application No. 106135617; 23 Pages.
Taiwan Examination Report (with English Translation) dated Nov. 2, 2018 for Taiwan Application No. 106135613; 20 Pages.

(56) References Cited

OTHER PUBLICATIONS

Taiwan Examination Report (with English Translation) dated Nov. 26, 2018 for Taiwan Application No. 106135418; 8 Pages.
U.S. Final Office Action dated Jan. 2, 2019 for U.S. Appl. No. 15/381,286; 16 Pages.
U.S. Non-Final Office Action dated Jan. 11, 2019 for U.S. Appl. No. 15/379,761; 20 Pages.
U.S. Notice of Allowance dated Dec. 14, 2018 for U.S. Appl. No. 15/731,906; 9 Pages.
Response (with English Translation, Claims and Specification) to Taiwan Examination Report dated Oct. 31, 2018 for Taiwan Application No. 106135617; Response filed Jan. 7, 2019; 22 Pages.
Response (with English Translation and Specification) to Taiwan Examination Report dated Nov. 2, 2018 for Taiwan Application No. 106135613; Response filed Jan. 8, 2019; 9 Pages.
Taiwan Examination Report and Search Report (with English Translation) dated Apr. 15, 2019 for Taiwan Application No. 106135617; 21 Pages.
Response to Non-Final Office Action dated Feb. 27, 2019 for U.S. Appl. No. 15/381,286; Response filed May 21, 2019; 12 Pages.
Taiwan Statement of Reasons for Re-Examination (with Reporting Letter dated Jan. 8, 2019 and English Translation) dated Jan. 8, 2019 for Taiwan Application No. 106135418; 7 Pages.
Response to U.S. Final Office Action dated Jan. 2, 2019 for U.S. Appl. No. 15/381,286; Response and RCE filed Feb. 5, 2019; 10 Pages.
U.S. Non-Final Office Action dated Feb. 27, 2019 for U.S. Appl. No. 15/381,286; 17 Pages.
Taiwan Allowance Decision (with English Translation) dated Mar. 20, 2019 for Taiwan Application No. 106135613; 4 Pages.
Japanese Final Office Action (with English Translation) dated Feb. 28, 2017 for Japanese Application No. 2015-541757; 4 Pages.
European Examination Report dated Jun. 21, 2018 for European Application No. 13721516.6; 6 Pages.
Response to European Examination Report dated Jun. 21, 2018 for European Application No. 13721516.6; Response filed Oct. 26, 2018; 16 Pages.
U.S. Notice of Allowance dated Apr. 4, 2019 for U.S. Appl. No. 15/731,906; 5 Pages.
U.S. Final Office Action dated Jun. 11, 2019 for U.S. Appl. No. 15/381,286; 18 Pages.
PCT International Preliminary Report dated Jun. 27, 2019 for International Application No. PCT/US2017/054836; 9 Pages.
PCT International Preliminary Report dated Jun. 27, 2019 for International Application No. PCT/US2017/055059; 13 Pages.
PCT International Preliminary Report dated Jun. 27, 2019 for International Application No. PCT/US2017/055222; 9 Pages.
European Communication Pursuant to Rules 161(1) and 162 EPC dated Jul. 23, 2019 for European Application No. 17785128.4; 3 Pages.
European Communication Pursuant to Rules 161(1) and 162 EPC dated Jul. 23, 2019 for European Application No. 17791226.8; 3 Pages.
European Communication Pursuant to Rules 161(1) and 162 EPC dated Jul. 23, 2019 for European Application No. 17784814.0; 3 Pages.
Response (with Machine English Translation from Google Translator) to Taiwan Examination Report dated Apr. 15, 2019 for Taiwan Application No. 106135617; Response filed Jul. 4, 2019; 18 Pages.
Response to U.S. Final Office Action dated Jun. 11, 2019 for U.S. Appl. No. 15/381,286; Response filed Jul. 17, 2019; 7 Pages.
Response to U.S. Non-Final Office Action dated Jan. 11, 2019 for U.S. Appl. No. 15/379,761; Response filed May 13, 2019; 14 Pages.
European Examination Report dated Sep. 9, 2019 for European Application No. 13721516.6; 4 pages.
Taiwan Office Action (with English Translation) dated Sep. 20, 2019 for Taiwan Application No. 106135418; 14 pages.

* cited by examiner

HIGH FREQUENCY POLYMER ON METAL RADIATOR

GOVERNMENT RIGHTS

This invention was made with U.S. Government support. The Government has certain rights in the invention.

BACKGROUND

Performance of an array antenna is often limited by the size and bandwidth limitations of the antenna elements which make up the array. Improving the bandwidth while maintaining a low profile enables array system performance to meet bandwidth and scan requirements of next generation of communication applications, such as software defined or cognitive radio. These applications also frequently require antenna elements that can support either dual linear or circular polarizations.

SUMMARY

In one aspect, a unit cell of a phased array antenna includes a metal plate having a hole, a first side and a second side opposite the first side, a first plurality of laminate layers disposed on the first side, a second plurality of layers disposed on the second side of the metal plate, a radiator disposed in the first plurality of layer on the first side, a feed circuit disposed in the second plurality of laminate layers on the second side and configured to provide excitation signals to the radiator and a first plurality of vias extending through the hole connecting the feed circuit to the radiator.

In another aspect, a method of manufacturing a unit cell of a phased array antenna includes machining a metal plate to have at least one hole, filling the at least one hole with a laminate, adding a first plurality of laminate layers to a first surface of the metal plate, adding a second plurality of laminate layer to a second surface of the metal plate opposite the first surface, adding a radiator in the first plurality of layer on the first side; adding a feed circuit in the second plurality of laminate layers on the second side and configured to provide excitation signals to the radiator and adding a plurality of vias extending through the hole connecting the feed circuit to the radiator.

DETAIL DESCRIPTION

Described herein is a phased array antenna that includes one or more unit cells. In one example, the unit cell includes a high frequency radiator fabricated in a polymer-on-metal (POM) structure.

The unit cell described herein provides one or more of the following advantages. The unit cell provides out-of-band filtering and shielding inherently. The unit cell is well grounded, low profile structure that controls surface wave propagation extended frequency and scan performance. The unit cell provides excellent axial ratio performance over scan out to 60°. High density thin film metallization on a laminate achieves 0.002" linewidths and gaps. The unit cell has thermal management benefits due to a metal plate.

Current loop radiators have been successfully realized in printed wiring board (PWB) technology from frequencies ranging from C-band to K-band. At Ka-band and above it becomes difficult to maintain performance due to the sensitivity of the radiator performance to via location and the need for smaller gaps and linewidths. In PWB technology, via location from nominal can vary within a 0.01" diameter circle centered on nominal, meaning that vias can move as much as 0.005" in any direction. As frequency increases, the wavelength and unit cell decrease, so this movement becomes more significant. Additionally, PWB technology has difficulty realizing linewidths and gaps below 0.004" due to limitations of the processing and equipment. The approach described herein enable producible current loop elements for high frequencies.

Polymer on Metal (POM) technology offers the needed improvement. High density thin film metallization on a liquid crystalline polymer (LCP) attached to a metal plane can achieve 0.002" linewidths and gaps. Misregistration of these metallization layers is greatly reduced compared to PWB technology, which helps reduce maximum via movement from 0.005" to <0.001". Additionally, vias are made with precision laser micro-machining, not drill bits. This combination of improvements provides the ability to realize current loops at much higher frequencies than was possible before. POM technology offers additional advantages in thermal management and shielding. Because the radiator circuit is constructed around a metal plate of significant thickness (e.g., 0.02"), it possesses waveguide-like frequency rejection properties for out-of-band frequencies. Construction can be simplified by placing the feed circuitry on one side of the metal plate and the radiating structure on the other. This simplifies fabrication of the POM circuitry and reduces fabrication cost by reducing the number of laminations required.

Figure 1A:
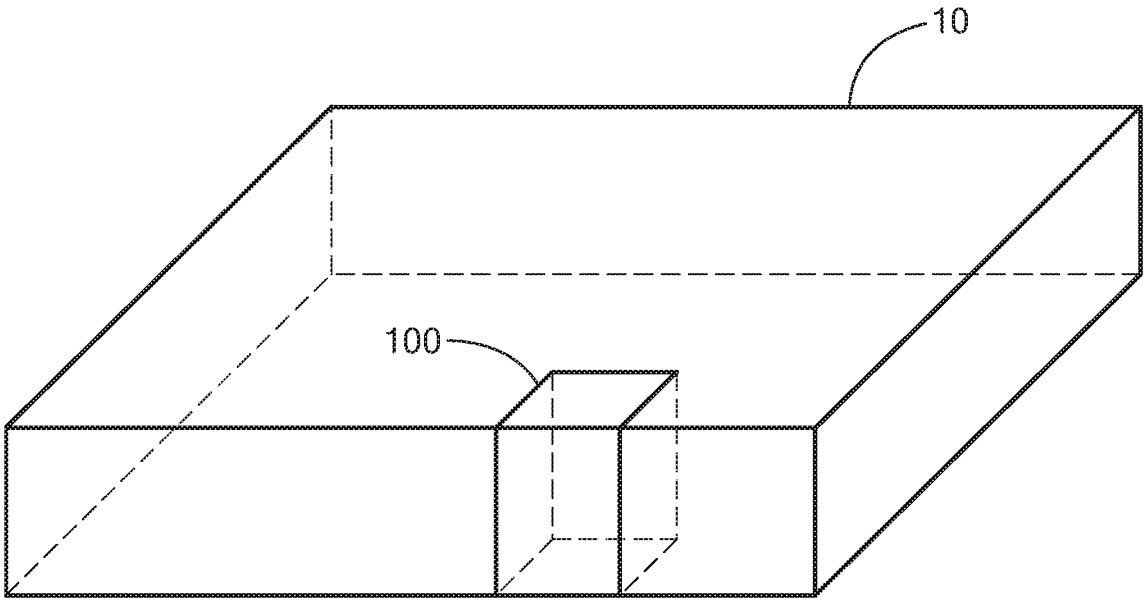
FIG. 1A is a diagram of an example of a phased antenna array.

Referring to FIG. 1A, a phased array antenna 10 includes unit cells (e.g., a unit cell 100). In some examples, the phased array antenna 10 may be shaped as a rectangle, a square, an octagon and so forth.

Figure 1B:
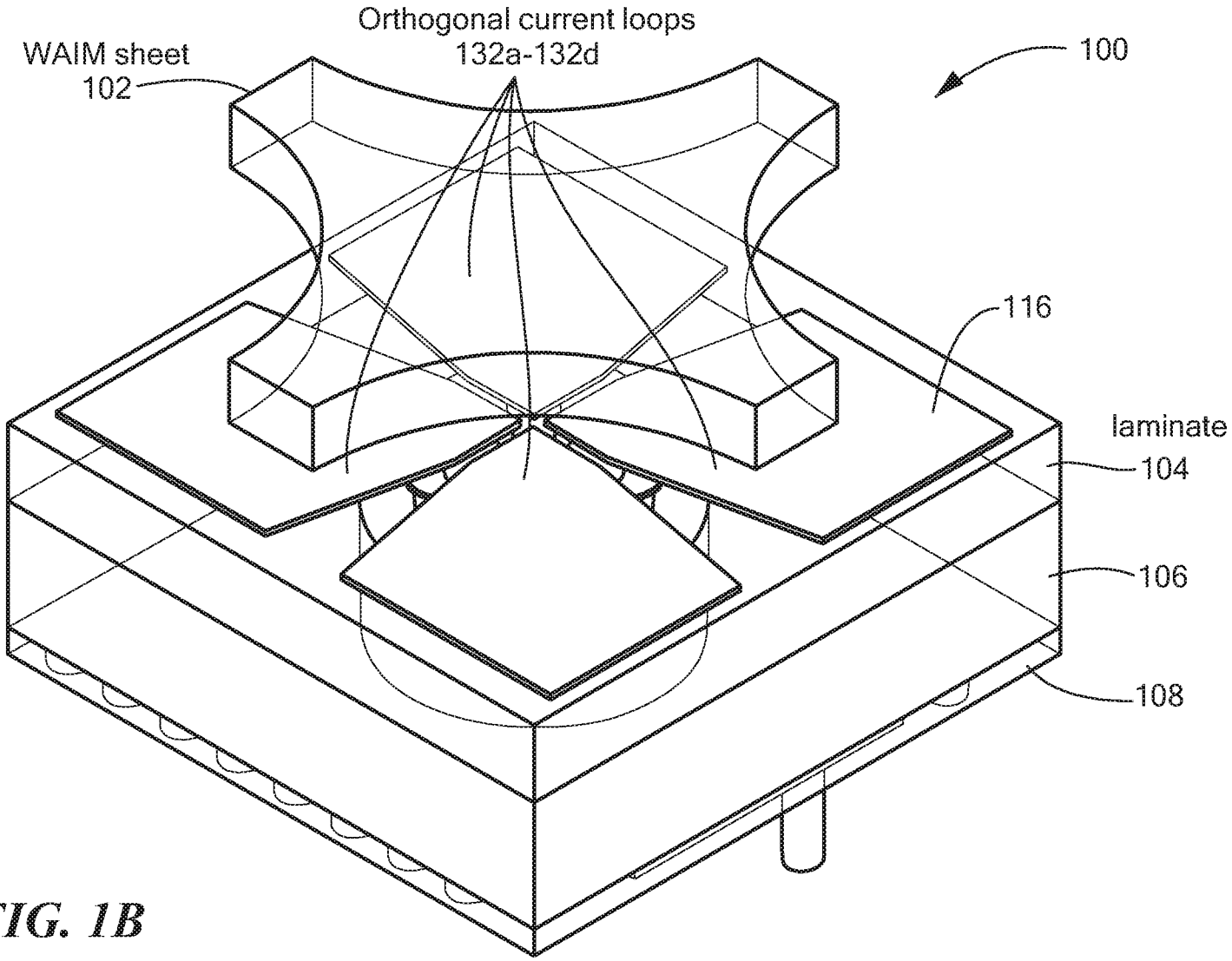
FIG. 1B is a diagram of an example of a unit cell of the phased array antenna.
Figure 1C:
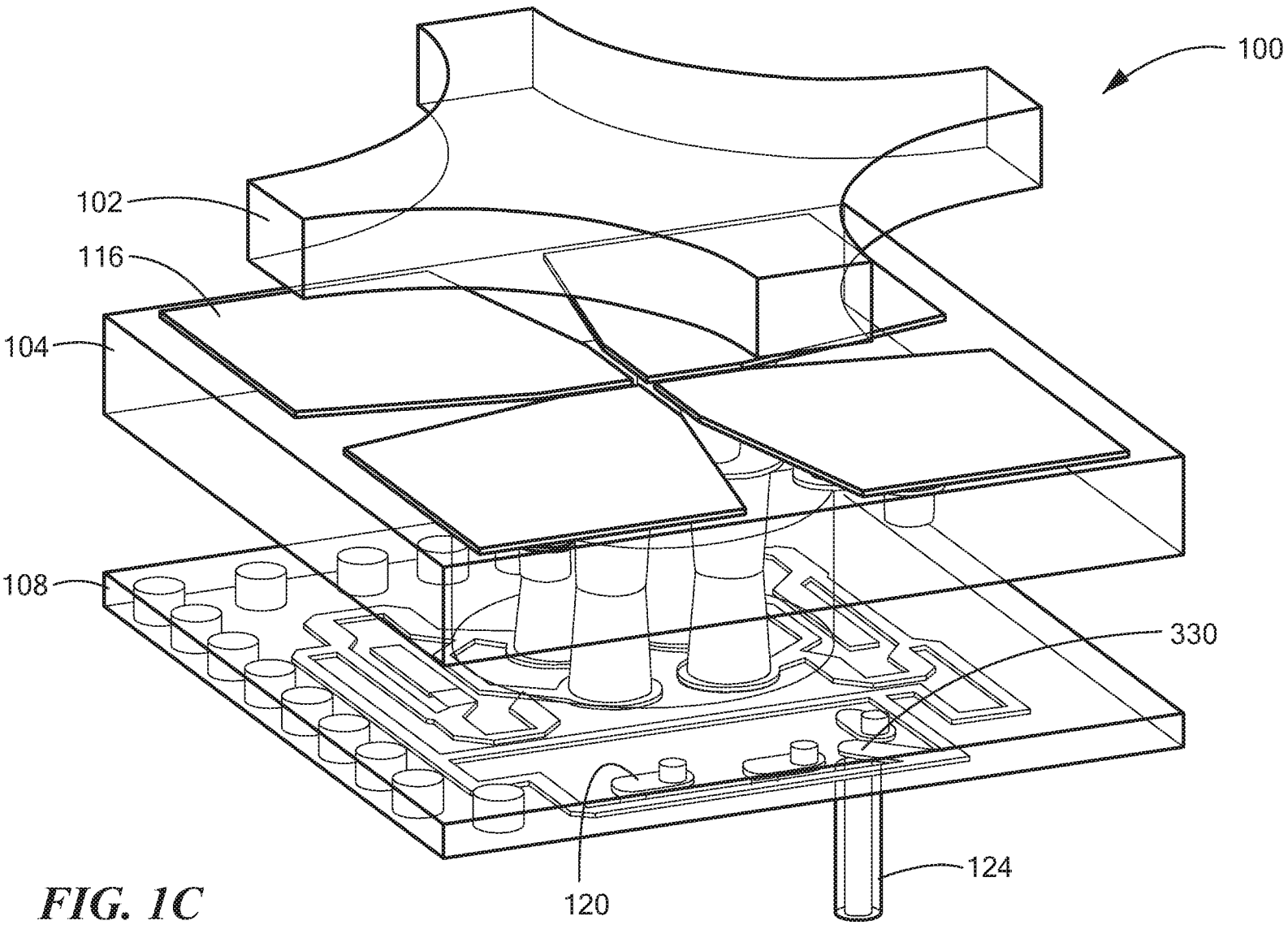
FIG. 1C is a diagram of the unit in FIG. 1 without a metal plate.
Figure 1D:
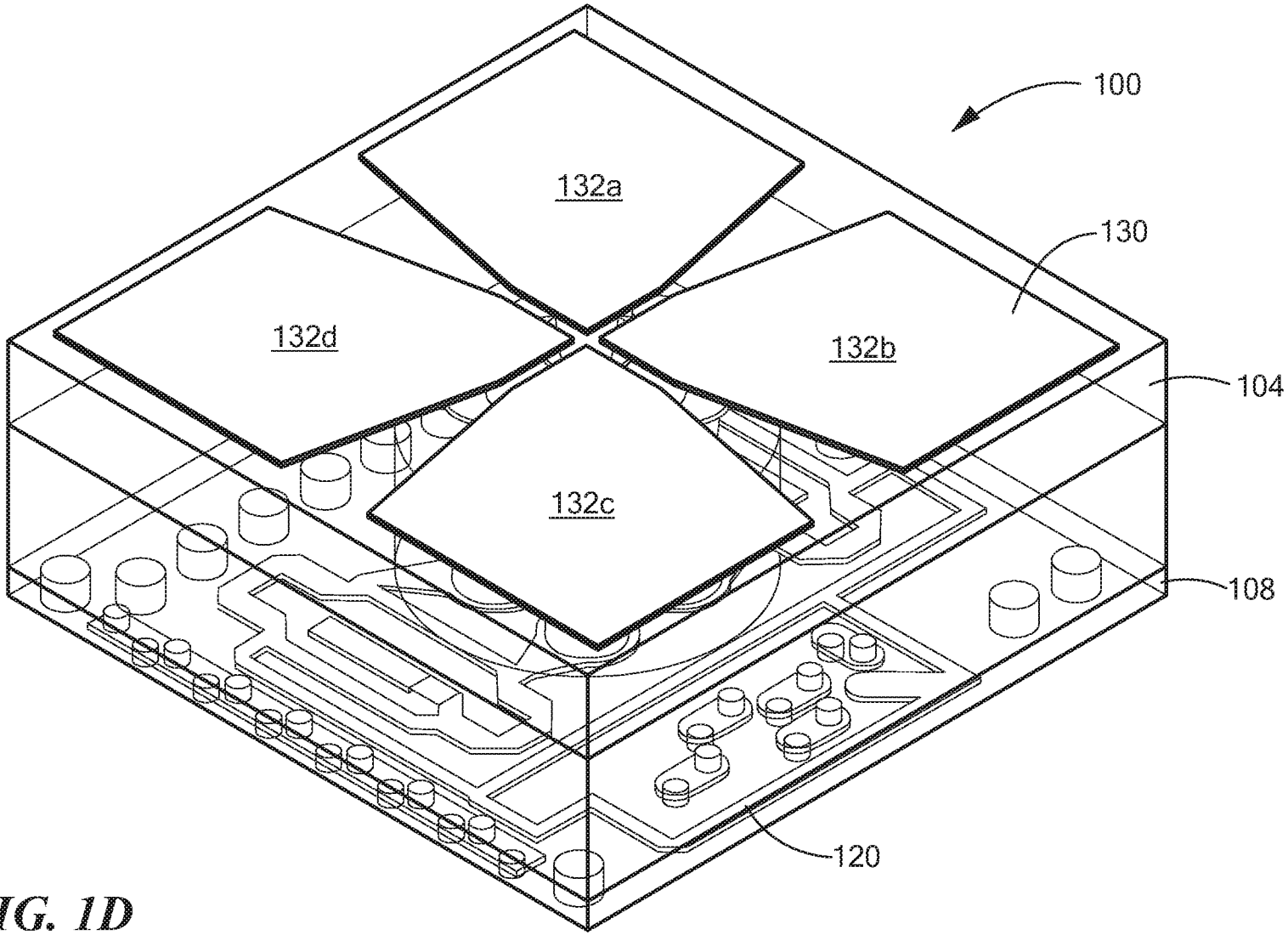
FIG. 1D is a diagram of an example of the unit cell without the wide-angle impedance matching layer.

Referring to FIGS. 1B to 1D, in one example, the unit cell 100 includes a wide-angle impedance matching (WAIM) layer 102, a first laminate region 104, a metal plate 106, a second laminate region 108, a radiator 116 with orthogonal current loops 132*a*-132*d* and a quadrature phase feed circuit 120. The unit cell 100 also includes vias (e.g., vias 122*a*-122*d* (FIG. 2B)) that provides excitation signals from the feed circuit 120 to the radiator 116, which, for example, controls surface waves and improves the bandwidth of the radiator and its performance over scan. The feed circuit 120 includes a coaxial port 330 that receives signals provided by an RF connector 124.

In one example, the WAIM sheet is a 0.01" Cyanide Ester resin/quartz pixelated WAIM. In one example, the first laminate region 104 and the second laminate region 108 are liquid crystalline polymer (LCP) laminates. The first laminate region 104 may include one or more layers of laminate. The second laminate region 108 may include one or more layers of laminate. As will be further described herein, metallization (including vias 122*a*-122*d*) may be added after a laminate layer is added. For example, the vias 122*a*-122*d* are formed in stages.

Figure 2A:
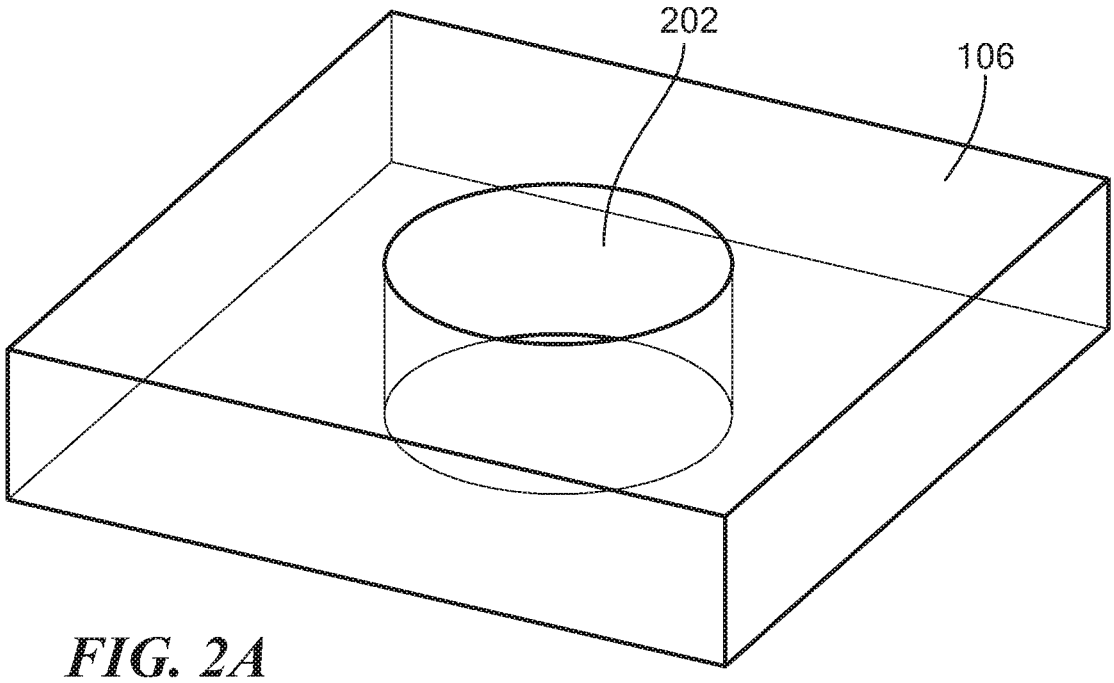
FIG. 2A is a diagram of an example of a metal plate used, for example, for shielding.
Figure 2B:
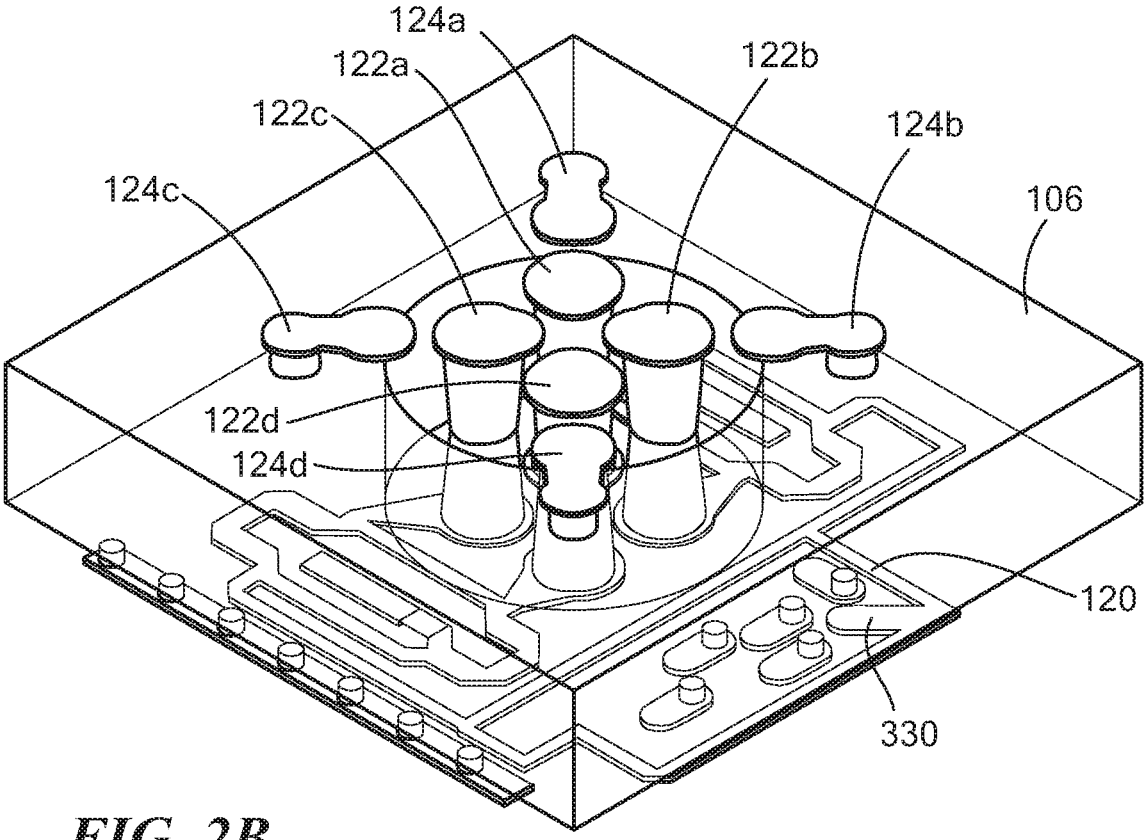
FIG. 2B is a diagram of an example of the metal plate of FIG. 2A with vias and a feed circuit.

Referring to FIGS. 2A and 2B, the metal plate 106 includes at least one hole 202. In one example, the metal plate is a shield. In one example, the metal plate includes a nickel-iron alloy such as is 64FeNi or Invar. The presence of the hole 202 produces a waveguide-like component to the current loop radiator 116, which can be used to improve key performance parameters by controlling the spacing of the vias 122*a*-122*d* from each other and the metal wall plus the depth and diameter of the hole 202 in the metal plate 106.

Each of the dipole arms 132*a*-132*d* is grounded to the metal plate 106 by a corresponding via. For example, the dipole arm 132*a* is grounded using a via 124*a*, the dipole arm 132*b* is grounded using a via 124*b*, the dipole arm 132*c* is grounded using a via 124*c* and the dipole arm 132*d* is grounded using a via 124*d*. In one example, one or more of the vias 122*a*-122*d* are added at a particular distance from a respective via 124*a*-124*d* to control tuning.

In one example, the vias (e.g., vias 122*a*-122*d* and vias 124*a*-124*d*) are micromachined laser vias that allow high accuracy placement of the vias that reduce performance variations in the built part. It is important to the successful design of the radiator that the layers of the stackup are implemented in such a way that the vias needed can be realized as required for radiator performance, particularly, balancing such elements as the diameter of the hole 202 in the metal plate 106 to be large enough that the four signal vias 122*a*-122*d* between the feed circuit 120 and the radiator 116 can be realized and small enough that the ground vias 124*a*-124*d* between the radiator circuit layer 116 and the metal plate 106 can be placed close enough to the signal vias 122*a*-122*d* to be effective at eliminating the propagation of surface waves in the dielectrics (e.g., laminates).

Figure 3:
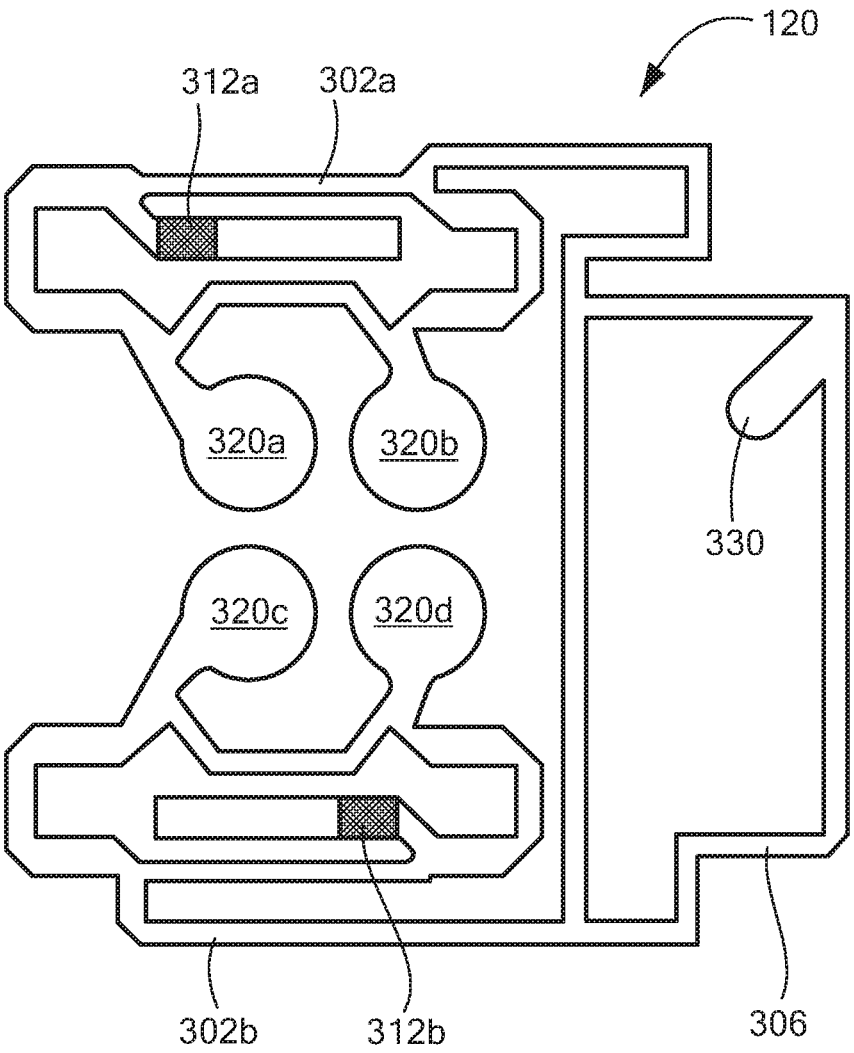
FIG. 3 is a top view of an example of a feed circuit.

Referring to FIG. 3, the quadrature feed circuit 300 includes branch couplers 302*a*, 302*b* coupled to a rat-race coupler 306. The branch coupler 302*a* includes pads 320*a*, 320*b* and a resistor 312*a*; and the branch coupler 302*b* includes pads 320*c*, 320*d* and a resistor 312*b*. The resistors 312*a*, 312*b* may be selected to control isolation between the branch couplers 202*a*, 202*b*, which improves scan performance.

The pads 320*a*-320*d* are connected to a corresponding one of the radiator dipole arms 132*a*-132*d* using the vias 122*a*-122*d* (FIG. 2B) to provide 0°, 90°, 180°, 270° excitation of the radiator. The rat-race coupler 306 includes the coaxial port 330 to receive signals from the RF connector 124. In one example, the difference in phase between the signals provided to pads 320*a*, 320*b* is 90° and the difference in phase between the signals provided to pads 320*c*, 320*d* is 90°. In one particular example, the feed circuit 120 provides signals to the dipole arms 132*a*-132*d* using right hand circular polarization (RHCP).

Figure 4:
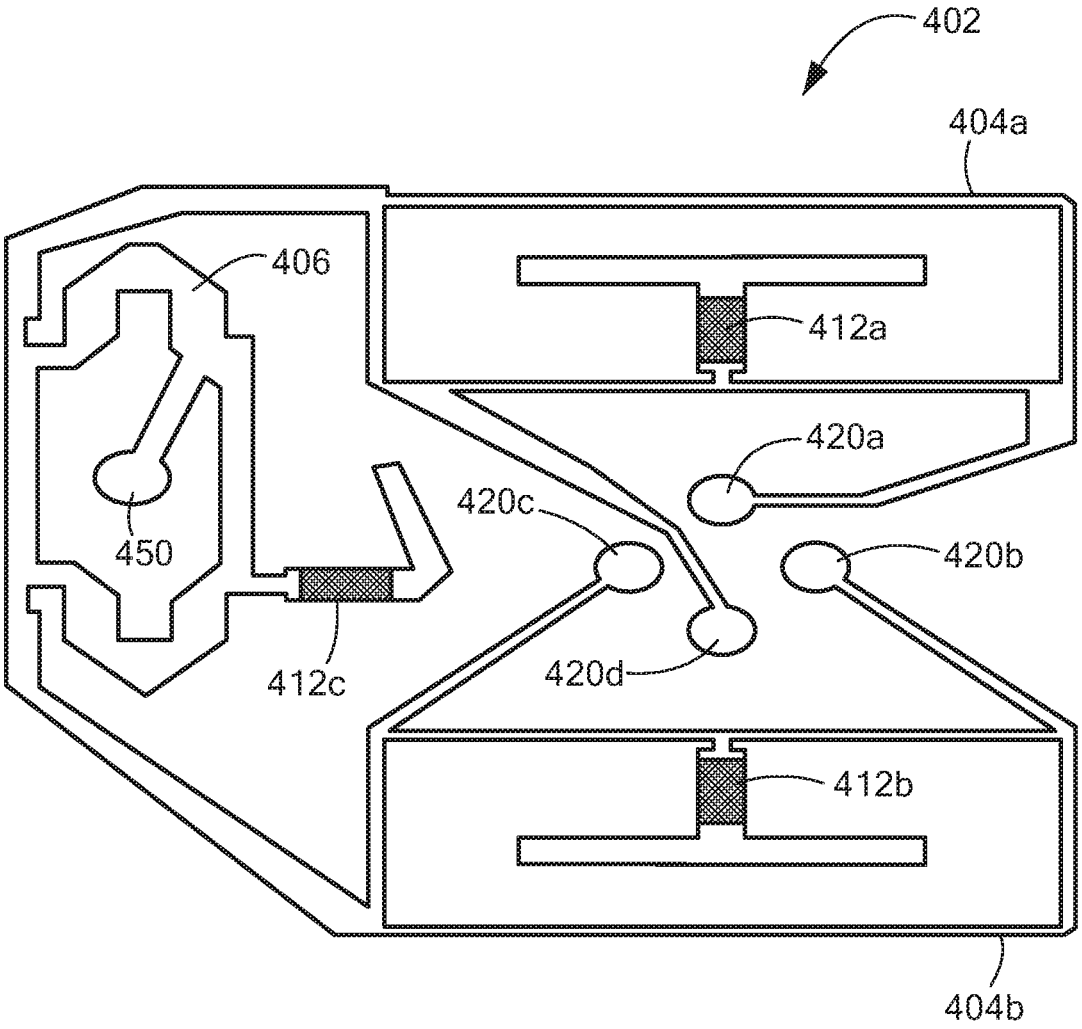
FIG. 4 is a top view another example of a feed circuit.

Referring to FIG. 4, another example of a quadrature phase feed circuit is the feed circuit 402. The quadrature feed circuit 300 includes rat-race couplers 404*a*, 404*b* coupled to a branch coupler 406. The rat-race coupler 404*a* includes pads 420*a*, 420*c* and a resistor 342*a*; and the rat-race coupler 404*b* includes pads 420*b*, 420*d* and a resistor 312*b*. The branch coupler 406 includes a resister 412*c* and a pad 450.

The resistors 412*a*-412*c* provide isolation between the first rat-race coupler 402*a*, the second-rat-race coupler 402*b* and the branchline coupler 406, which improves scan performance. The branch coupler 406 is connected to the RF connector 124 at the pad 450.

The pads 420*a*-420*d* are connected to a corresponding one of the radiator dipole arms 132*a*-132*d* using the vias 122*a*-122*d* (FIG. 2B) to provide 0°, 90°, 180°, 270° excitation of the radiator. The signals to the dipole arms 132*a*, 132*c* are 180° out of phase from one another and the signals to the dipole arms 132*b*, 132*d* are 180° out of phase from one another. In one example, the signals to the dipole arms 132*a*, 132*b* are 90° out of phase from one another and the signals to the dipole arms 132*c*, 132*d* are 90° out of phase from one another. In one particular example, the feed circuit 402 provides signals to the dipole arms 132*a*-132*d* using right hand circular polarization (RHCP).

Figure 5:
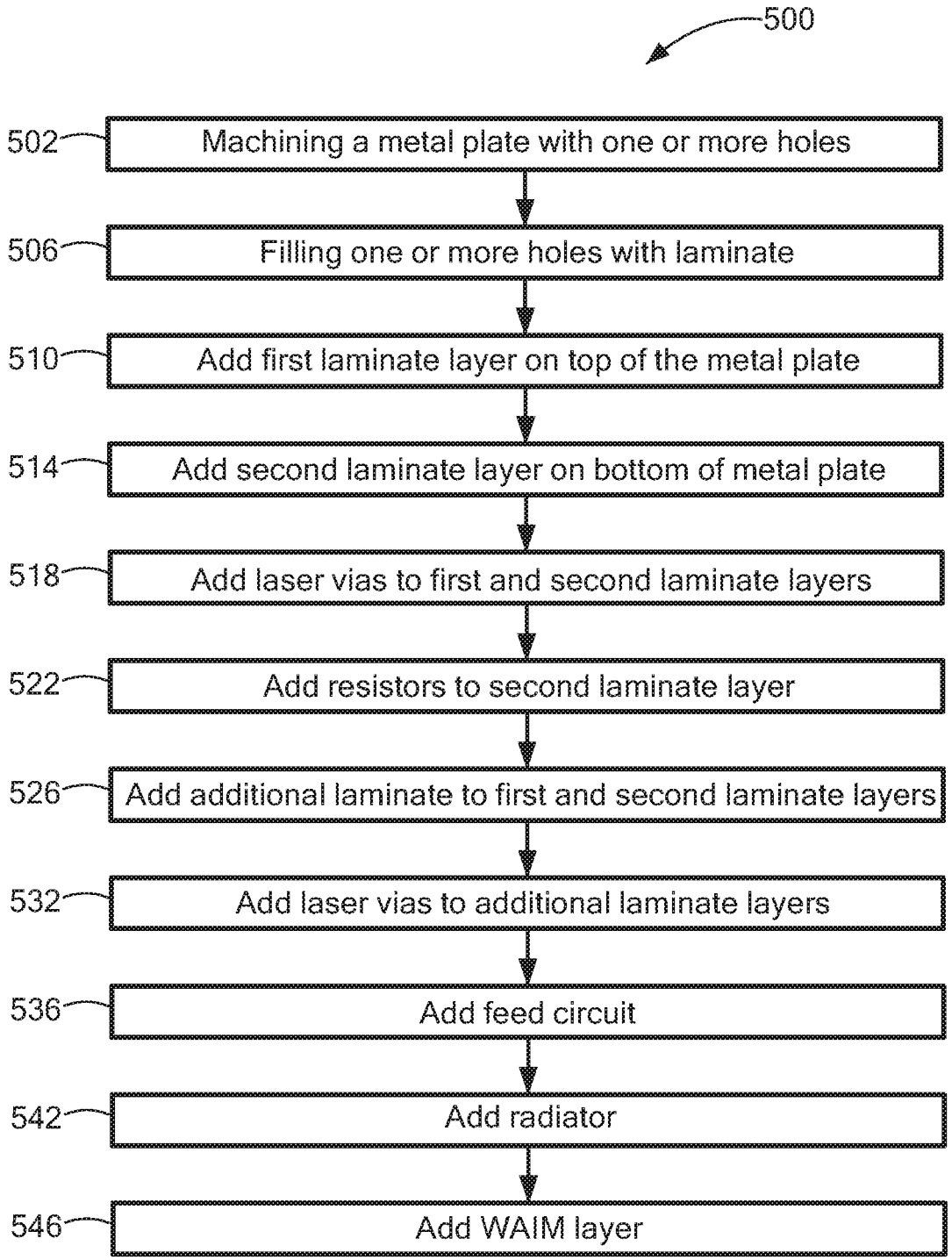
FIG. 5 is a flowchart of an example of a process to manufacture the unit cell.

Referring to FIG. 5, a process 500 is an example of a process to manufacture a unit cell 100. Process 500 machines a metal plate with one or more holes (502). For example, the metal plate 106 with the hole 202 is formed using wire electrical discharge machining (EDM) or a hole 202 is machined out from the metal layer 106.

Process 500 fills one or more of the holes (506). For example, the hole 202 of the metal plate 106 is filled with an LCP.

Process 500 adds a first laminate layer to a top surface of the metal plate (510). For example, a first laminate layer of LCP is added to the top surface of the metal layer 106. In one particular example, 0.004' of LCP is added.

Process 500 adds a second laminate layer to a bottom surface of the metal plate (514). For example, a second laminate layer of LCP is added to the bottom surface of the metal layer 106. In one particular example, 0.002' of LCP is added.

Process 500 adds laser vias to the first and second laminate layers (518). In one particular example, the first and second layers are patterned for the laser vias. For example, 0.01" laser vias are added to the first and second laminate layers. In another example, 0.006" laser vias are added to the first laminate layer 104 and 0.003" laser vias are added to the second laminate layer 108. In one example, the staggered 0.003" laser vias are or grounding where the larger via size would be unable to fit.

Process 500 adds resistors to the second laminate layer (522). For example, resistors (e.g., 25 Ohms per square material (OPS)) are added to the second laminate layer 108. In one example, the resistors include the resistors 312*a*, 312*b* in the feed circuit 120.

Process 500 add additional laminate to the first and second laminate layers (526). For example, 0.002" of LCP is added to the second laminate layer 108 and 0.008" of LCP is added to the first laminate layer 104.

Process 500 adds laser vias to the additional laminate layers (532). In one particular example, the first and second layers 104, 108 are patterned for the laser vias. In another example, 0.003" and 0.006" laser vias are added to the second laminate layer 108 and 0.008" laser vias are added to the first laminate layer 104. In one example, with the formation of the 0.008" laser vias that are stacked on top of the 0.008" vias added (see, for example, processing block 518), the signal vias 122*a*-122*d* are completed.

Process 500 adds the feed circuit (536). For example, the feed circuit 120 is formed, using metallization, to connect to the signal vias 122*a*-122*d*.

Process 500 adds the radiator (542). For example, the radiator 116 is formed, using metallization, to connect to the ground vias 124*a*-124*d* and the signal vias 122*a*-122*d*

Process 500 add WAIM layer (546). For example, the WAIM layer 102 is added and place above the first laminate region 104 leaving an air gap of 0.02" between the first laminate region 104 and the WAIM layer 102.

The processes described herein are not limited to the specific examples described. For example, the process 500 is not limited to the specific processing order of FIG. 5. Rather, any of the processing blocks of FIG. 5 may be re-ordered, combined or removed, performed in parallel or in serial, as necessary, to achieve the results set forth above.

Elements of different embodiments described herein may be combined to form other embodiments not specifically set forth above. Various elements, which are described in the context of a single embodiment, may also be provided separately or in any suitable subcombination. Other embodiments not specifically described herein are also within the scope of the following claims.

What is claimed is:

1. A unit cell of a phased array antenna comprising:

a metal plate having a hole, a first side and a second side opposite the first side;

a first plurality of laminate layers disposed on the first side;

a second plurality of laminate layers disposed on the second side of the metal plate;

a radiator disposed in the first plurality of laminate layers on the first side;

a feed circuit disposed in the second plurality of laminate layers on the second side and configured to provide excitation signals to the radiator;

a first plurality of vias extending through and contained in a length of the hole connecting the feed circuit to the radiator; and a second plurality of vias located outside of the hole at respective distances from the first plurality of vias connecting the radiator to the metal plate through the first plurality of laminate layers.

2. The unit cell of claim 1, wherein the metal plate comprises a nickel-iron alloy.

3. The unit cell of claim 2, wherein the nickel-iron alloy is 64FeNi.

4. The unit cell of claim 1, wherein the radiator comprises:

a first dipole arm;

a second dipole arm;

a third dipole arm; and a fourth dipole arm.

5. The unit cell of claim 4, wherein the plurality of vias comprises:

a first via coupled to the first dipole arm;

a second via coupled to the second dipole arm;

a third via coupled to the third dipole arm and a fourth via coupled to the fourth dipole arm, wherein the first, second, third and fourth vias provide the excitation signal from the feed circuit.

6. The unit cell of claim 5, wherein the feed circuit comprises:

a first branchline coupler coupled to the first via and the second via;

a second branchline couple coupled to the third via and the fourth via;

a rat-race coupler coupled to the first and second branchline couplers.

7. The unit cell of claim 6, wherein the feed circuit further comprises:

a first resistor coupled to the first branchline coupler; and a second resistor coupled to the second branch coupler; and wherein the first and second resistors provide isolation between the first branchline coupler and the second branchline coupler.

8. The unit cell of claim 5, wherein the feed circuit comprises:

a first rat-race coupler coupled to the first via and the third via;

a second rat-race couple coupled to the second via and the fourth via;

a branchline coupler coupled to the first and second rat race couplers.

9. The unit cell of claim 7, wherein signals to the first and third dipole arms are 180° out of phase from one another, and wherein signals to the second and fourth dipole arms are 180° out of phase from one another.

10. The unit cell of claim 9, wherein signals to the first and second dipole arms are 90° out of phase from one another, and wherein signals to the third and fourth dipole arms are 90° out of phase from one another.

11. The unit cell of claim 8, wherein the feed circuit further comprises:

a first resistor coupled to the first rat-race coupler;

a second resistor coupled to the second rat-race coupler; and a third resistor coupled to the branchline coupler, wherein the first, second and third resistors provide isolation between the first rat-race coupler, the second-rat-race coupler and the branchline coupler.

12. The unit cell of claim 5, further comprising:

a fifth via coupled to the first dipole arm;

a sixth via coupled to the second dipole arm;

a seventh via coupled to the third dipole arm and an eighth via coupled to the fourth dipole arm, wherein the fifth, sixth, seventh and eighth vias provide ground.

13. The unit cell of claim 1, wherein the feed circuit is a quadrature phase feed circuit.

14. The unit cell of claim 1, wherein the feed circuit supplies signals to the radiator using right hand circular polarization (RHCP).

15. The unit cell of claim 1, wherein at least one of the first laminate layer and the second laminate layer is a liquid crystalline polymer (LCP).

16. The unit cell of claim 1, further comprising a wide-angle impedance matching sheet (WAIM) disposed near the first laminate layer.

17. The unit cell of claim 1, wherein the unit cell performs at Ka-band or higher frequencies.

18. A method of manufacturing a unit cell of a phased array antenna, comprising:

machining a metal plate to have at least one hole;

filling the at least one hole with a laminate;

adding a first plurality of laminate layers to a first surface of the metal plate;

adding a second plurality of laminate layers to a second surface of the metal plate opposite the first surface; and adding a radiator in the first plurality of laminate layers on the first side;

adding a feed circuit in the second plurality of laminate layers on the second side and configured to provide excitation signals to the radiator;

adding a first plurality of vias extending through and contained in a length of the hole connecting the feed circuit to the radiator; and adding a second plurality of vias located outside of the hole at respective distances from the first plurality of vias connecting the radiator to the metal plate through the first plurality of laminate layers.

19. The method claim 18, further comprising adding a wide-angle impedance matching sheet (WAIM) disposed near the first plurality of laminate layers.

20. The unit cell of claim 1, wherein the location of the first and second plurality of vias tunes the radiator for minimizing propagation of surface waves in the first and second plurality of laminate layers.

* * * * *